United States Patent [19]

Panttila

[11] Patent Number: 4,597,310

[45] Date of Patent: Jul. 1, 1986

[54] DRIVE ARRANGEMENT FOR CYLINDERS IN A PAPER MACHINE

[75] Inventor: Vaino Panttila, Saynatsalo, Finland

[73] Assignee: Valmet Oy, Finland

[21] Appl. No.: 735,781

[22] Filed: May 20, 1985

Related U.S. Application Data

[63] Continuation-in-part of Ser. No. 411,085, Aug. 23, 1982, abandoned.

[30] Foreign Application Priority Data

Aug. 26, 1981 [FI] Finland ..... 812630

[51] Int. Cl.[4] ..... F16H 37/06; F16H 1/12; F16H 57/02; F26B 13/18

[52] U.S. Cl. ..... 74/665 GA; 74/421 R; 74/606 R; 34/121

[58] Field of Search ... 74/665 GA, 665 GB, 665 GC, 74/421 R, 606 R, 410, 413; 34/121

[56] References Cited

U.S. PATENT DOCUMENTS

| | | | |
|---|---|---|---|
| 269,574 | 12/1882 | Haskin | 74/665 GA X |
| 1,533,130 | 4/1925 | Millspaugh | 34/121 X |
| 1,616,383 | 2/1927 | Malkin | 34/121 |
| 1,670,832 | 5/1928 | Vedder | 34/121 |
| 1,730,082 | 10/1929 | Malkin | 34/121 |
| 1,857,222 | 5/1932 | Vedder | 34/121 |
| 2,578,552 | 12/1951 | Hornbostel | 34/121 |
| 2,857,773 | 10/1958 | Slonek | 74/421 R X |
| 2,914,864 | 12/1959 | Clem | 34/121 |
| 2,953,942 | 9/1960 | Schwartz et al. | 74/665 GA |
| 3,378,936 | 4/1968 | Buss | 34/121 |
| 3,694,927 | 10/1972 | Sorenson | 34/121 |
| 3,698,265 | 10/1972 | Williams | 74/665 GA |
| 3,783,710 | 1/1974 | Steinhagen | 74/665 GA |
| 4,103,565 | 8/1978 | Matikainen et al. | 74/665 L |
| 4,181,039 | 1/1980 | Phelps | 74/665 GA |
| 4,253,246 | 3/1981 | Marchal | 34/121 |

FOREIGN PATENT DOCUMENTS 53733 3/1978 Finland .

*Primary Examiner*—Kenneth J. Dorner
*Assistant Examiner*—Stephen B. Andrews
*Attorney, Agent, or Firm*—Steinberg & Raskin

[57] ABSTRACT

A drive arrangement for cylinders, such as drying cylinders, in a paper machine of the type which comprises a number of cogwheels, such as gears, which intermesh to constitute a gear transmission. The cogwheels of the gear transmission are fitted within a casing situated on the side of the drying section of the paper machine, and in accordance with the invention, both the cogwheel shafts as well as the axle journal of the drying cylinder to be driven are rotatably mounted or journaled to the same casing. The casing in which the cogwheels are fitted is substantially trapezoidal in shape, preferably a "regular" trapezoid (the non-parallel sides are substantially equal in length). Several such trapezoidally-shaped casings may be co-operatively mounted in the drying section to form a composite drive arrangement for the cylinders.

3 Claims, 4 Drawing Figures

DRIVE ARRANGEMENT FOR CYLINDERS IN A PAPER MACHINE

BACKGROUND OF THE INVENTION

This is a continuation-in-part of co-pending U.S. patent application Ser. No. 411,085, filed Aug. 23, 1982 now abandoned.

The present invention relates to an arrangement for driving cylinders and, in particular, drying cylinders, of a paper machine. In particular, the present invention relates to the particular construction of a gear-type transmission constituted by a number of cogwheels the first of which is rotated by a drive shaft driven by a drive motor, the first cogwheel driving, either directly or through one or more intermediate cogwheels, a cogwheel fixed to the axle journal of a drying cylinder.

Various arrangements are known of driving mechanisms for rotating drying and press rolls in a paper or pulp machine which include a gear transmission which functions as a reducing gear transmission, i.e., to reduce the rotational speed of the drive motor. For example, it is conventional in press sections of paper machines to drive each of the press rolls by means of a relatively long cardan shaft which constitutes an extension of the end of the shaft of the roll. The cardan shaft is connected through a reducing gear transmission to the drive shaft of a drive motor by means of a flange coupling.

It is conventional in the prior art to couple a number of drying cylinders of a paper machine by means of gear transmissions so that an operating group including drying cylinders rotated by means of a single drive motor may include between about 4 to 12 drying cylinders.

In connection with the prior art technology relating to the present invention, reference is initially made to Finnish Patent No. 53,733 granted July 10, 1978 and owned by applicants' assignee. A mechanical drive arrangement is disclosed therein for rotating the drying and/or press roll or group of rolls of a paper or pulp machine which includes a planetary-type gear transmission. More particularly, a gear transmission is disclosed comprising a planetary gear arrangement which is driven by a drive motor to rotate the shaft of the roll to be driven. The arrangement is incorporated within the driven equipment and fitted so that the ring gear is connected directly to the frame of the paper or pulp machine, by means of a toothed coupling, socket-spring coupling or the like. For example, the ring gear may be connected directly to the bearing block or the like, without any journaling between the planet carrier and the ring gear. Moreover, the planetary gear transmission includes a planet carrier which rotates with the shaft which drives the roll and the shaft of the sun gear is driven by the drive motor.

Reference is also made in connection with the prior art technology to U.S. Pat. No. 4,181,039 assigned to The Black Clawson Company. A drive arrangement is disclosed in that patent for rotating the drying cylinders of a paper machine wherein the drying cylinders are driven by means of separate double-pin gears and wherein the drying cylinders are mounted by means of bearings to the frame of the drive side of the drying section. The shafts of the cylinders are driven by means of separate gear transmissions which are provided within a casing which is separate and distinct from the side of the frame on the paper machine drive side and from the frame section in which the cylinders are journaled or rotatably mounted.

The conventional arrangements described above wherein the cylinders or rolls of a paper machine are driven by separate gear transmissions housed within separate casings, has, however, proved to be not entirely satisfactory in that the construction is relatively complicated and rather bulky.

SUMMARY OF THE INVENTION

Accordingly, it is an object of the present invention to provide a new and improved drive arrangement for cylinders in a paper machine, and, in particular, a drive arrangement for the paper machine drying cylinders, which is of an integrated construction thereby eliminating the need for separate gear transmissions with separate casings.

Another object of the present invention is to provide a new and improved mechanical drive arrangement for rolls or cylinders in a paper machine wherein the drive motor can be situated directly alongside the frame of the drying section so that the paper machine can be situated within a space in a paper machine which can be narrower at this area.

Briefly, in accordance with the present invention, these and other objects are attained by providing a drive arrangement comprising a number of cogwheels constituting a gear transmission, one of the cogwheels being rotated by the drive shaft to drive a cogwheel fixed to the axle journal of a drying cylinder through the mediation of a side-cogwheel, and wherein the cogwheels are arranged within a casing situated at the side of the drying section of the paper machine and in which casing both the shafts of the cogwheels as well as the proximate axle journal of the drying cylinder to be driven are rotatably mounted or journaled.

The casing in which the cogwheels are fitted is substantially trapezoidal in shape, preferably a "regular" trapezoid (the non-parallel sides are substantially equal in length). Several such trapezoidally-shaped casings may be co-operatively mounted in the drying section to form a composite drive arrangement for the cylinders.

The present invention provides several important practical advantages relative to the conventional related technology disclosed in the above-discussed U.S. Pat. No. 4,181,039.

One of the more important advantages provided by the construction of the drive arrangement of the present invention is that by means of the integrated construction of the gear transmission, substantial savings are obtained in the manufacture of the drive arrangement since the frame of the drying section and the frame or casing of the gear transmission are partly constituted by the same structure. Moreover, the same bearings which rotatably mount the axle journal of the cylinder being driven also serve to rotatably mount the cogwheel associated with the cylinder so that the same bearings are used in lieu of separate sets of bearings as is conventional. In this manner, the installation of the apparatus of the present invention is significantly less complicated than in conventional arrangements. Still further, the number of electric motors and associated equipment required by the present invention is significantly lower than that required in conventional arrangements as is the number of supply and control devices.

Another advantage provided by the present invention relative to the conventional arrangements described in the abovementioned patents is that environmental control, such as airconditioning and ventilation, of the paper machine can accomplished with less difficulty since the pin-type gear and machine frame of the prior art together effectively obstruct the spaces between the cylinders in the lower line.

Several important advantages are also provided by the fitting of the cogwheels within a casing of substantially trapezoidal shape. When the casings are cooperatively mounted in the drying section to form a composite drive arrangement for the cylinders, the trapezoidally-shaped casings do not cover the "pockets" of the felt-guiding rolls and provide relatively open spaces within the drying section. This is important with a view towards ventilating the drying section.

Only a single shape of casing need be manufactured. This shape can be used to accomodate the cogwheels of two rows of drying cylinders, both an upper row and a lower row. This is accomplished by simply inverting the trapezoidally shaped casings for the lower row of cogwheels so that the longer bases of adjacent casings in the upper and lower rows face one another. Moreover, additional cogwheels may be conveniently fitted in a particular trapezoidally-shaped casing without causing difficulties and without disturbing the overall composite drive arrangement.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 2:
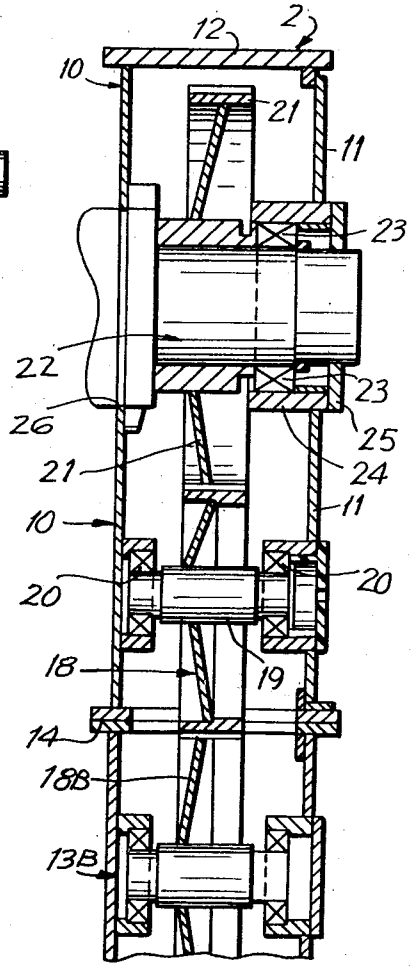
FIG. 2 is a sectional view taken along line II—II in FIG. 1.

Referring now to the drawings wherein like reference characters designate identical or corresponding parts throughout the several views, a drive arrangement for an operating group of drying cylinders in accordance with the present invention is illustrated. One operating group of drying cylinders can typically include 4 to 12 drying cylinders, generally driven by the same motor and transmission. In the illustrated embodiment, the group of drying cylinders is driven by means of a drive shaft 15 which is connected in a conventional manner, such as by means of a short highspeed cardan shaft, to an electric motor (not shown).

The drive arrangement of the present invention comprises a gear transmission, described in detail below, housed within a casing, generally designated 2. The casing in the illustrated embodiment is formed of a pair of spaced vertical walls 10 and 11 which are fixed to a base 14. The upstanding walls 10 and 11 are interconnected by means of side walls 12 and 13.

In accordance with an important feature of the present invention, the casing 2 which functions to house the gear transmission of the drive arrangement at the same time constitutes the frame to which the drying cylinder to be driven by the gear transmission is journaled. In the figures, only the axle journal 22 of the drying cylinder which is proximate to the driving frame side is illustrated. The axle Journal 22 is rotatably supported by the casing 2 by means of bearings 23 supported in the casing wall 11 by an annular member 24, a covering flange 25 being provided to cover the bearing. Thus, the axle journal 22 of the drying cylinder passes through and is rotatably mounted on the casing 2 which houses the gear transmission of the drive arrangement therefor.

Figure 3:
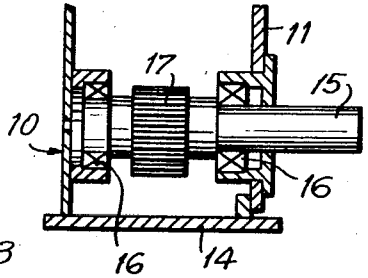
FIG. 3 is a sectional view taken along line III—III in FIG. 1.

The drive shaft 15 coupled to the drive motor is itself rotatably journaled in the walls 10 and 11 of casing 2 by means of bearings 16 (FIG. 3) mounted in suitable fittings fixed to the side walls 10 and 11 of the casing. A small-diameter cogwheel 17 is fixed on the drive shaft 15 within casing 2. The cogwheel 17 meshes with a larger-diameter cogwheel 18 rotatably mounted within the casing 2. Thus, the cogwheel 18 is fixed on a shaft 19 which is journaled at its ends in bearings 20 supported on the side walls 10 and 11 of casing 2 by appropriate fittings. The cogwheel 18 is situated substantially laterally or to the side of the cogwheel 17 so that cogwheel 18 or similarly situated cogwheels may be referred to as side-cogwheels.

The side-cogwheel 18 meshes with and drives a cogwheel 21 which is situated within the casing 2 and fixed to the axle journal 22 of the drying cylinder. Thus, as noted above, the axle journal 22 of the drying cylinder is mounted within a bearing 23 which itself is mounted on the side wall 11 of casing 2 by appropriate mounting elements. It is understood that the other end of the drying cylinder may be conventionally journaled, such as in the remote side of the paper machine frame. A seal 26 is preferably provided between the wall 10 of casing 2 and the axle journal 22.

An appropriate transmission ratio is obtained through the suitable selection of the cogwheels 17, 18 and 21. Thus, an appropriate gear reduction may be provided so that the drive shaft 15 may be a high-speed shaft and, therefore, relatively thin. Likewise, the power transmission equipment between the drive shaft 15 and the drive motor (not shown) may be of relatively light constructions.

The gear transmission described above may also be used to drive additional drying cylinders of the same operating group of cylinders to which the drying cylinder having the axle journal 22 belongs. In this connection, a second side-cogwheel 27 is situated with the casing 2 fixed on a shaft 28 rotatably mounted on the side walls 10 and 11 of the housing in the same manner as the shaft 19 of cogwheel 18. The second side-cogwheel 27 has a diameter which is substantially equal to the diameter of the first sidecogwheel 18. Thus, the second side-cogwheel 27 meshes with and is driven by the cogwheel 21 fixed on the axle journal 22 and through one or more intermediate cogwheels 27A, drives an additional cogwheel 21A (corresponding to cogwheel 21) which is fixed on the axle journal of a second drying cylinder. The axle journal of the second drying cylinder of course corresponds to axle journal 22. The cogwheel 21A fixed to the axle journal of the second drying cylinder may itself drive a third side-cogwheel for thereby rotating a next drying cylinder. Cogwheels 27A and 21A are fitted within a second casing 13A.

By the same token, cogwheel 18 can be used to drive an intermediate cogwheel 18B, which in turn drives a cogwheel 21B which is fixed on the axle journal of a third drying cylinder. Cogwheels 18B and 21B are disposed in a third casing 13B as illustrated in FIG. 1.

Figure 1:
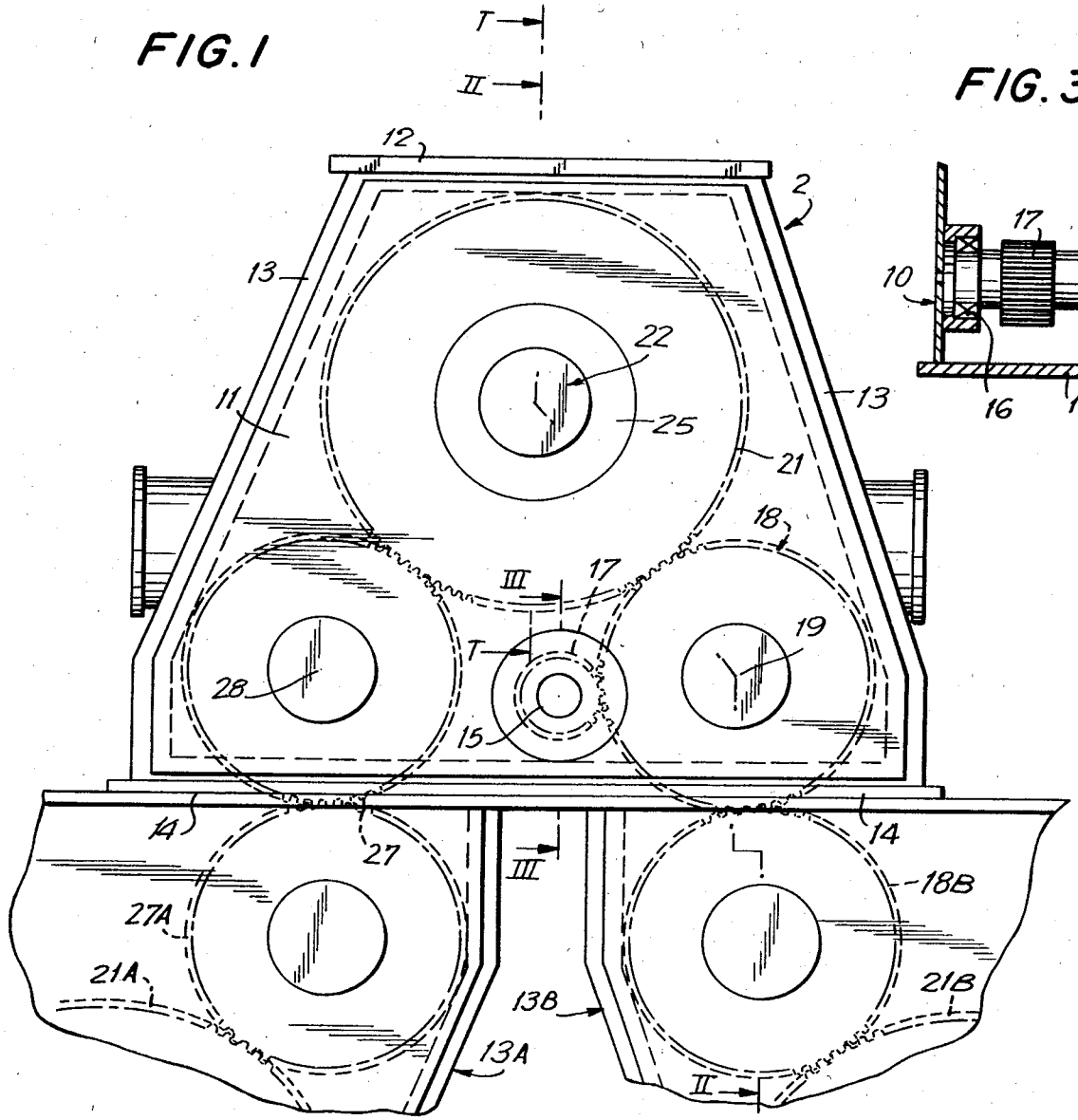
FIG. 1 is a schematic side elevational view of a drive arrangement in accordance with the present invention.

As seen in FIG. 1, the illustrated embodiment of the drive arrangement of the present invention has a substantially symmetrical configuration with respect to a vertical plane T—T which passes through the center of the axle journal 22 of the drying cylinder to be driven. The side-cogwheels 18 and 27 are thus located substantially symmetrically on both sides of the plane T—T. The only substantial deviation from the symmetrical configuration of the drive arrangement is that the center of the drive shaft 15 which passes through the space defined by the outer circumferences of cogwheels 18, 21 and 27 in the bottom region of the casing 2 is displaced somewhat towards the first side-cogwheel 18 from the plane T—T. In this way, the drive arrangement is provided wherein the various components are efficiently positioned to optimize economy in space utilization.

The individual casings 2, 13A, 13B are substantially trapezoidal in shape. In other words, the opposite walls 10 and 11 of the casing 2 are substantially trapezoidal in shape as illustrated. In particular, the side walls 13 which extend between the base 14 and the side wall 12 of casing 2 are substantially equal in length, such that the casing 2 has the shape of a substantially "regular" trapezoid.

Figure 4:
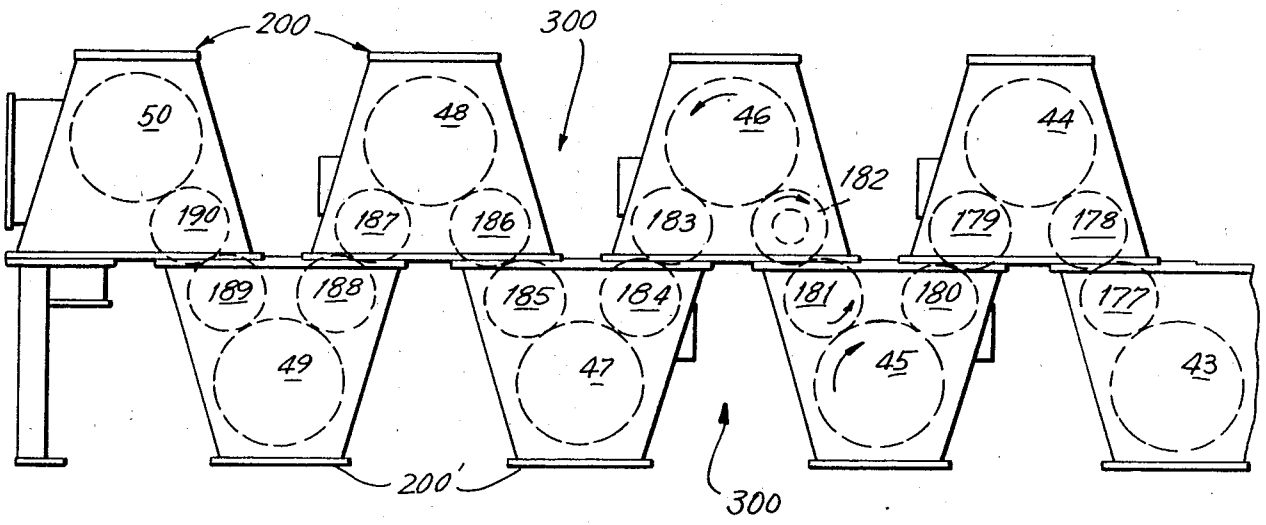
FIG. 4 is a schematic side elevational view of a composite drive arrangement of the present invention comprising several adjoining casings.

In this regard, FIG. 4 illustrates several trapezoidally-shaped casings 200, 200' cooperatively mounted in the drying section to form a composite drive arrangement for the respective drying cylinders. In particular, two rows of casings are mounted next to one another, an upper row of casings 200, and a lower row of casings 200'. The casings 200' forming the lower row are simply inverted as illustrated to form the composite drive arrangement.

In the cooperative drive arrangement illustrated in FIG. 4, cogwheels 43–50 are each disposed upon respective axle journals of respective drying cylinders. Cogwheel 182 which is disposed upon a drive shaft, serves to directly drive cogwheel 46, and to indirectly drive cogwheels 43–45 and 47–50 through respective intermediate cogwheels 177–181 and 183–190, which are supported and journaled in the respective casings as illustrated.

As seen in FIG. 4, all cogwheels 43–50 and 117–190 are accomodated in vertically adjacent casings 200, 200'. The casings in each row are staggered with respect to the vertically adjacent casings in the next row such that the bases 14 of each of the casings 200 of the upper row overlap a portion of the base 14 of a pair of vertically-adjacent casings 200' in the lower row as illustrated. By the same token, the base 14 of the casings 200' in the lower row also overlap a portion of the bases 14 of a pair of casings 200' in the upper row. Thus spaces or "pockets" 300 are defined between each adjacent pair of casings in a horizontal row, and the base 14 of a vertically adjacent casing. The casings at the extreme ends of the respective rows, will naturally only overlap a portion of one vertically, adjacent casing (please see, e.g., the extreme left casing 200 in the upper row in FIG. 4).

As clearly seen in FIG. 4, the trapezoidal shape of the various casings 200, 200' conveniently accomodated the entire gear transmission, while at the same time providing numerously open spaces or "pockets" 300 within the drying sections which is important for providing ventilation therein.

It is seen rm the foregoing that a drive arrangement for cylinders in a paper machine is provided comprising a casing in which a gear transmission is provided and wherein the axle journal of the drying cylinder to be driven is journaled in the same casing. The gear transmission is preferably constituted by a number of cogwheels advantageously arranged in an efficient manner whereby the drying cylinders belonging to an operating group thereof can be driven. In this manner, an integrated construction of a drive arrangement is provided which is fundamentally simpler in construction and less costly in manufacture than conventional arrangements. Moreover, it is also seen that the arrangement of the present invention allows the spaces between the cylinders in a lower line of drying cylinders to remain open thereby facilitating ventilation thereof.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A drive arrangement for a group of cylinders comprising two rows of casings, an upper row and a lower row, each row comprising a plurality of trapezoidally-shaped casings, a cogwheel fixed to an axle journal of a cylinder being situated in each casing, and at least one side-cogwheel situated in each casing, said side-cogwheel coupled with said cylinder cogwheel in said respective casing and with a side-cogwheel in a vertically-adjacent casing, and wherein said casings in each row are staggered with respect to vertically-adjacent casings in the next row such that a base of each casing overlaps a portion of a base of a vertically-adjacent casing, said casings of said lower row having a substantially inverted configuration from said casings of said upper row, and said staggered casings defining ventilation spaces between adjacent casings of the same row and a portion of the base of a vertically-adjacent casing.

2. The arrangement of claim 1, wherein one of said side-cogwheels in one of said casings constitutes a drive cogwheel for driving the remaining cogwheels.

3. The arrangement of claim 1, additionally comprising a drive wheel situated in one of said casings and coupled to said side-cogwheel in said one of said casings, for driving said remaining cogwheels.

* * * * *